US006176794B1

(12) United States Patent
Kim

(10) Patent No.: US 6,176,794 B1
(45) Date of Patent: Jan. 23, 2001

(54) IMPACT BOOSTING POWER TEE FOR GOLF BALL

(76) Inventor: Frank Y. H. Kim, 9880 S. Bathhurst Wy., Highlands Ranch, CO (US) 80126

( * ) Notice: Under 35 U.S.C. 154(b), the term of this patent shall be extended for 0 days.

(21) Appl. No.: 09/234,462

(22) Filed: Jan. 21, 1999

Related U.S. Application Data

(60) Provisional application No. 60/093,277, filed on Jul. 17, 1998.

(51) Int. Cl.[7] ..... A63B 57/00
(52) U.S. Cl. ..... 473/402; 473/392
(58) Field of Search ..... 473/387–403; D21/717, 718

(56) References Cited

U.S. PATENT DOCUMENTS

| | | | | |
|---|---|---|---|---|
| 1,554,721 | | 9/1925 | Getchell | 473/403 |
| 1,595,130 | | 8/1926 | Wilcox | 473/392 |
| 1,800,647 | | 4/1931 | Krafft | 473/392 |
| 1,942,672 | | 1/1934 | Thompson | 473/392 |
| 2,082,811 | * | 6/1937 | Thorup | 473/402 |
| 2,107,706 | | 2/1938 | Morgan | 473/403 |
| 2,155,803 | | 4/1939 | Rider | 473/392 |
| 2,469,928 | | 5/1949 | Mursch | 473/388 |
| 3,907,289 | * | 9/1975 | Bondu, Sr. | 473/403 |
| 4,192,504 | * | 3/1980 | Clugage | 473/403 |
| 4,328,969 | | 5/1982 | Wright | 473/390 |
| 5,683,313 | * | 11/1997 | Disco et al. | 473/387 |
| 6,004,228 | * | 12/1999 | Adam | 473/403 |

* cited by examiner

*Primary Examiner*—Steven Wong
(74) *Attorney, Agent, or Firm*—Browdy and Neimark

(57) ABSTRACT

A tee for a golf ball has a ball-supporting surface (18) on the upper end which is offset from the lower stem (10), so that when the tee is placed in the ground with the stem substantially vertical the center of gravity of the ball is horizontally offset from the ground-insertion point. The ball-supporting surface is inclined at a tilt angle (θ) to the lower stem.

7 Claims, 1 Drawing Sheet

IMPACT BOOSTING POWER TEE FOR GOLF BALL

CROSS-REFERENCE TO RELATED APPLICATION

The present application claims priority from U.S. provisional application Ser. No. 60/093,277, filed Jul. 17, 1998, the entire contents of which are hereby incorporated by reference.

FIELD OF THE INVENTION

The present invention relates to a golf tee, i.e. a device for supporting a golf ball above the surface of the ground when driving the golf ball; and more particularly, a golf tee which supports the golf ball with its center of gravity displaced from that of the tee upon which it rests in such a way as to facilitate improved driving of the ball.

BACKGROUND OF THE INVENTION

The conventional golf tee places in one vertical line the center of gravity (CG) of the golf ball, the center of the depression in which the ball rests atop the tee, and the central line of the stem of the tee. The ball is balanced between gravity and the upward force of the rim of the tee depression, which exerts force on the ball uniformly around its rim. There is no predisposition to motion in any one direction.

A number of prior patents show golf ball supports of various types. Although these provide some improvements over the classic tee, the prior art constructions do not provide any functional improvement in the initial balance of the ball prior to club impact. If the tee is inclined to displace the ball's center of gravity, the amount of inclination is either insufficient or the ball has a tendency to topple the tee. Many of these are also expensive.

Conventional tees which perfectly balance the ball do not use the potential of inclination.

SUMMARY OF THE INVENTION

It is an object of the present invention to overcome deficiencies in the prior art, such as indicated above.

It is another object to provide an improved golf ball tee of low cost which, when made of plastic, is easily formed by injection molding.

It is a further object of the present invention to provide a golf ball tee which induces a powerful shot indirectly at impact, facilitates guiding of the ball along the desired path, controls the desired trajectory, and also performs regular tee functions.

These and other objects of the invention are achieved by the construction and use of a dual-inclination golf ball tee having its ball seat inclined from the horizontal plane an amount up to 15°, with the top part of the tee further banked at an angular inclination from the vertical axis up to 60°.

Due to the dual inclination the golfer is able to generate increased forces when he drives the ball, because of the positioning of the ball on the tee. The inclination of the ball-supporting surface causes the weight of the golf ball to locate to the lower side toward the direction from which the golf club head is approaching, and places the ball in optimum position for rotational, gravitational, and translational forces to act upon it when the square face of the driver impacts the ball.

In addition, the inclination of the ball-supporting stem from the vertical axis relocates the center of gravity of the ball, from a position directly above the main stem of the tee as is conventional, to a position offset from the main stem of the tee so as to minimize drag effects and thus maximize the transfer of energy directly from the club head to the ball.

BRIEF DESCRIPTION OF THE DRAWING FIGURES

The above and other objects and the nature and advantages of the present invention will be more apparent from the following detailed description of various embodiments taken in conjunction with the drawing, wherein.

DETAILED DESCRIPTION OF THE PREFERRED EMBODIMENTS

Figure 1:
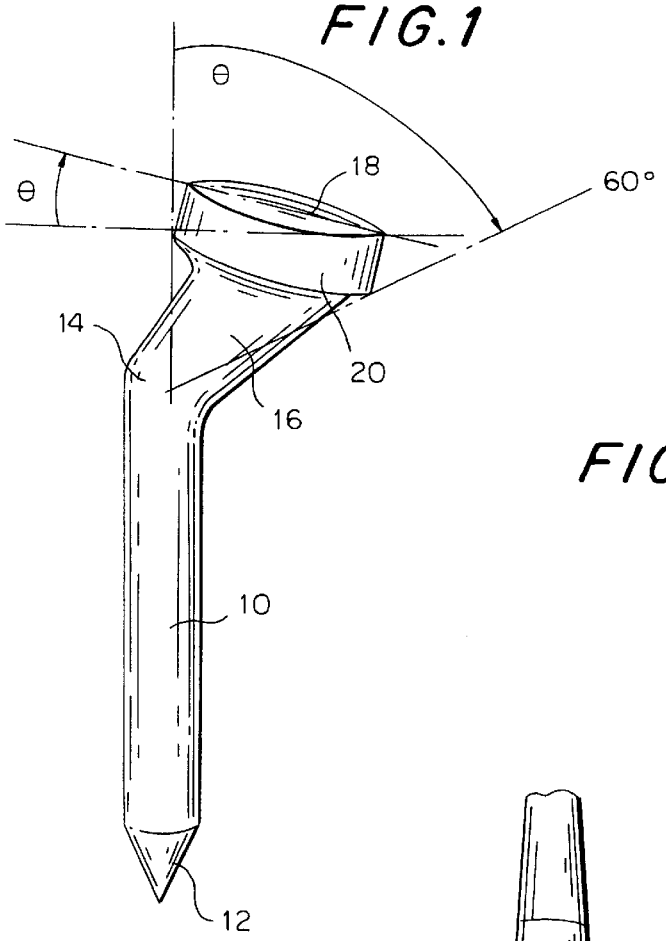
FIG. 1 is a perspective view of a first embodiment of the present invention.

The structure of the present invention is described in more detail below:

FIG. 1 is a perspective view of a preferred first embodiment according to the present invention. The tee consists essentially of a vertical main stem 10 having a pointed bottom end 12 for insertion into the ground so that the stem 10 can project vertically from the ground. The upper end of the main stem 10 terminates in an elbow 14 from which projects an upper or inclined stem portion 16. The inclined stem portion 16 is inclined (or, its axis is inclined) at an angle $\phi$ up to 60° from axis of the main stem 10.

At the upper end of the inclined stem portion 16 is a ball support seat, dish, or cavity 18. Preferably, the rim of the cavity 18 is inclined to the horizontal when the main stem 10 is vertical; and still more preferably, the inclination is in the opposite direction from the inclination of the inclined stem portion 16. That is, the plane of the cavity 18 rim is not perpendicular to the axis of the upper portion 16 and, equivalently, a line normal to the plane of the rim is not parallel to the upper stem portion 16. Instead, the line normal to the rim is inclined opposite to the inclination of the upper portion 16 away from the main portion 10, i.e. the normal line is tilted toward the right in FIG. 1 at an angle $\theta$.

In the preferred embodiments the axis of the main stem portion 10, the axis of the upper portion 16, and the normal to the plane defined by the rim of the ball-holding cavity 18 are all co-planar, but the present invention also contemplates the normal to the rim being skew, angled to the plane defined by the two axes.

The reverse inclination of the cavity 18 rim supports the golf ball in a slightly more upright position than would be the case if the rim plane, defined by the top edge of the seat or cavity 18, were perpendicular to the axis of the inclined upper stem portion 16. The preferred inclination angle $\theta$ from the horizontal plane is 0–15°, more preferably 7–15°; and most preferably 10–13°.

Figure 2:
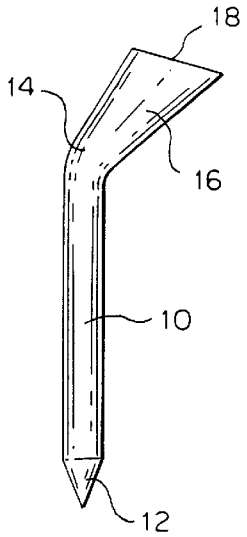
FIG. 2 is an elevational or side view of a second embodiment.

FIG. 2 shows an alternative and generally functionally equivalent embodiment. The main difference between the embodiments of FIGS. 1 and 2 is that the FIG. 1 embodiment is provided with a cylindrical collar 20 at its upper end which is not provided in the embodiment of FIG. 2.

Figure 3:
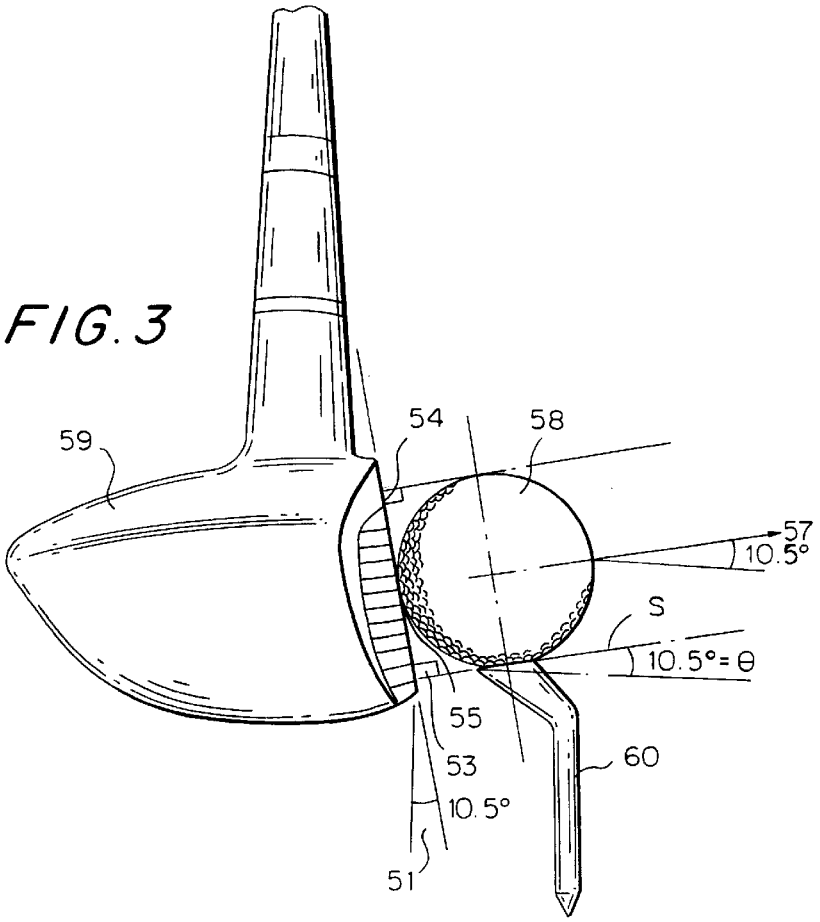
FIG. 3 is an environmental elevational view.

FIG. 3 shows the basic geometry of the present invention, in which the center of gravity of the ball 58 is offset from the stem of the tee 60. This offset has two aspects.

One aspect of the invention is that the lower stem 60 of the tee, which is generally vertical after being inserted into a point in the ground, is offset from the center of the ball-supporting surface S. This offset moves the tee away from the club head 59 and the point of impact. A golf ball will flatten under the force of impact and, with a conventional tee, the club will hit the tee while it is still in contact with the ball.

Since the tee is light, the effect is not great; but it is not negligible. The work required to dislodge the tee and fling it away is that much less energy available to propel the ball, and the distance driven is reduced.

In the present invention the offset ensures that the ball is off and away before the club hits the tee. Therefore the club is not slowed by hitting the tee during its contact with the ball, only afterward, and no energy is lost. The ball travels farther.

A second aspect of the present invention is that the ball-supporting surface is inclined in the opposite direction by an angle θ (exemplified in FIG. 3 as 10.5°). The face of golf club head 59 is angled to the club handle by an angle 51 and therefore the face is also angled to the direction of motion of the head 59, which is substantially horizontal if the golfer is at all skilled. Preferably the angle θ of the ball-supporting surface is equal to the angle 51 of the face of the club head 59.

Since the face 54 is angled, the ball 58 will be deflected upward on impact, and the angle of flight will be twice the angle of the face. Therefore the ball will be lifted off the supporting surface and move upward at an angle which is approximately twice the angle 51.

Therefore, the ball 58 will not hit against the rear edge of the ball-supporting surface on impact, no momentum will be transferred from the ball to the tee, and the ball will not be retarded by the inclination of the supporting surface.

On the other hand, the forward edge of the tee impedes the ball in the conventional tee, but not in the present invention. The reason is, again, the deformation of the ball on impact.

As the ball 58 flattens its diameter increases in a plane perpendicular to the hitting surface of the club head 59. This means that the ball pushes downward against the tee, driving it into the ground. But at the same time that the ball is being deformed it is also accelerating rapidly along its upward trajectory and rising upward as it moves horizontally. This causes the ball as a whole, including the lower surface to move upward, counteracting the downward push on the tee caused by deformation.

The initial downward push tends to rock the tee counter-clockwise as seen in FIG. 3 by pushing on the leading rim of the ball-supporting surface (toward the left in FIG. 3), but the inclination of the ball-supporting surface causes the ball to engage the trailing rim of the ball-supporting surface (on the right in FIG. 3) more than it otherwise would. By the time that the ball 58 touches the trailing rim it is moving backward, which rocks the tee clockwise and cancels the counter-clockwise rotation; moreover the ball 58 is by this time spinning counter-clockwise as seen in FIG. 3. The net effect is reduced rotation and less transfer of linear momentum from the ball 58 to the tee.

The present invention also encompasses an inclination of the ball-supporting surface in the opposite direction to that shown in FIG. 3. When the angle 51 of the striking face of the club 59 is small, the amount of rotation and the amount of rise of the ball are reduced, but the oblate shape and increase in diameter on striking the ball are not. Therefore the trailing of the ball-supporting surface may acquire more momentum than that needed to cancel the rotation which the tee acquires at the leading rim. Under these circumstances the engagement of the ball 58 with the trailing rim might possibly retard the ball's trajectory, depending on circumstances.

Inclination of the rim of the ball supporting cup 18, 18' in a direction opposite to the inclination of the upper stem potion 16 as is preferred also gives the secondary advantage of preventing toppling of the ball from the cup when the angle ϕ of the upper stem potion 16 from the vertical is maximized.

A level ball-supporting surface may be optimal for some clubs in the present invention.

Tees according to the present invention can be made of plastic and/or wood, although other materials can also be utilized. Relatively inexpensive thermoplastic material is preferred, e.g. polyethylene, polypropylene, PVC, and the tee is most preferably formed by injection molding.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation.

What is claimed is:

1. An impact boosting power tee for a golf ball, comprising a vertical main stem (10) adapted to be partially inserted into the ground so that a portion thereof projects vertically upwardly from the ground, an upper stem portion (16) projecting at a first angle (ϕ) of up to 60° from the vertical axis of said main stem, and a ball-supporting surface (18) at an upper end of said upper stem portion, said ball-supporting surface being inclined from horizontal at a second angle (θ) of up to 15°.

2. The golf ball supporting tee according to claim 1, wherein a direction of inclination of said ball supporting surface is opposite from a direction of inclination of said upper stem portion.

3. The golf ball supporting tee according to claim 1, wherein said second angle of inclination from horizontal of said ball-supporting surface is 7–15°.

4. The golf ball supporting tee according to claim 3, wherein said second angle of inclination from horizontal of said ball-supporting surface is 10–13°.

5. In a golf ball tee of the type adapted to support a golf ball having a center of gravity, the tee having a ball-supporting surface on an upper end thereof and a substantially straight lower stem adapted to be partially inserted into the ground at a ground insertion point, the improvement wherein:

the center of gravity of the golf ball is capable of being offset from the insertion point when the lower stem is substantially vertical;

wherein the offset comprises a horizontal displacement of the ball-supporting surface from the ground insertion point, and wherein the offset comprises the ball-supporting surface being inclined at a tilt angle to the stem.

6. The improvement according to claim 5, wherein the offset comprises:

a horizontal displacement of the ball-supporting surface from the ground insertion point; and the ball-supporting surface being inclined at a tilt angle to the stem; and wherein the tilt angle being generally collinear with the horizontal displacement.

7. The improvement according to claim 6, wherein the tilt angle is aligned with the horizontal displacement.

* * * * *